US005100483A

United States Patent [19]

Rhoads

[11] Patent Number: 5,100,483

[45] Date of Patent: Mar. 31, 1992

[54] METHOD OF CASE HARDENING FERROMETALLIC PARTS

[75] Inventor: Mark A. Rhoads, Cincinnati, Ohio

[73] Assignee: Cincinnati Milacron Inc., Cincinnati, Ohio

[21] Appl. No.: 690,208

[22] Filed: Apr. 24, 1991

[51] Int. Cl.[5] ..... C21D 1/48

[52] U.S. Cl. ..... 148/16.5; 148/19

[58] Field of Search ..... 148/16.5, 19

[56] References Cited

U.S. PATENT DOCUMENTS

| | | | |
|---|---|---|---|
| 3,398,444 | 8/1968 | Nemy | 29/159.2 |
| 4,154,628 | 5/1979 | Dudek et al. | 148/16.5 |
| 4,173,501 | 11/1979 | Hildebrandt et al. | 148/16.5 |
| 4,629,518 | 12/1986 | Larsen | 148/16.5 |
| 4,711,676 | 12/1987 | Kitamori et al. | 148/319 |
| 4,771,689 | 9/1988 | Arzoumanian et al. | 101/93.04 |

OTHER PUBLICATIONS

"Machinery's Encyclopedia", vol. II, E. Oberg and F. D. Jones, The Industrial Press, New York (1917) pp. 2-20.

*Primary Examiner*—John P. Sheehan

*Attorney, Agent, or Firm*—John W. Gregg; Donald Dunn

[57] ABSTRACT

A method of case hardening ferrometallic parts that avoids the use of protective coatings or shields is provided. The process comprises the steps of a) carburizing the entire part, b) machining the carburized part to form first and second surface regions wherein the second surface region has a carbon content at least 100% greater than the carbon content of the first surface region, c) heating the machined part at a hardening temperature with the entire part in contact with a gaseous atmosphere containing a source of carbon and a carbon content of from 85% to 115% of the carbon content of said first surface region, and d) quenching the part.

5 Claims, 1 Drawing Sheet

METHOD OF CASE HARDENING FERROMETALLIC PARTS

This invention pertains to a method for case hardening ferrometallic parts.

BACKGROUND

To increase the wear resistance of a ferrometallic part and thereby increase the useful life of such part it is well known in the art to harden the surface of the part, especially in selected regions, by increasing the carbon content of such surface along with a heat treatment of the part. This technique is known as case hardening. The prior art methods of case hardening ferrometallic parts typically involves carburizing the surface of the part by heating it in contact with a solid carbon containing material or in a gaseous atmosphere containing a source of carbon. This step produces a carburized part (i.e. a part whose carbon content at the surface region has been increased significantly over its original carbon content and that of the carbon content of the core region of the part). The part is then heated at a hardening temperature for some period of time. After being heated to the hardening temperature the part is then quenched (i.e. cooled) by immersion in oil or water or cooled gradually by exposure to ambient air. This process produces chemical, microstructural, mechanical and physical changes in the surface region of the part.

Increasing the carbon content in the surface region of a ferrometallic part along with the heat treatment, in the case hardening process, produces a hard wear resistant surface which can be more brittle than the softer, tougher, lower carbon content regions of the part. Such a hard surface is often desirable in obtaining a part having a long useful life. It is often desirable in the art to produce ferrometallic parts having hard, wear resistant surface regions adjacent to softer, tougher regions. For example, it may be desirable to produce a metal gear having hard wear resistant teeth surfaces and a tough, non-brittle hub. Selective case hardening is a means for producing such a part. In the prior art case hardening methods such a gear may be obtained by coating the portion of the gear that is not to be carburized (i.e the hub) with a carbon impervious material (e.g. copper plating or fire clay) to prevent carbon from penetrating into the surface at that portion of the gear during the carburizing step The remaining uncoated portion of the gear (i.e the teeth) is exposed to a carbon source (e.g. a gaseous atmosphere having a source of carbon) during the carburizing and heat treating steps and thus picks up carbon to create a hard, wear resistant surface. The amount of carbon picked up by the uncoated portion of the gear is essentially established in the carburizing step and is maintained in the heat treating step by a gaseous atmosphere whose carbon content is essentially the same as the carbon content of the carburized portion of the gear. Thus in the heat treating step, with such a carbon containing atmosphere, the concentration of carbon in the carburized portion of the gear is kept essentially constant. After the heat treating step and quenching the coating is removed from the non-carburized portion of the gear. The use of copper plating has temperature limitations in the carburizing and heat treating steps to prevent burning off of the layer of copper. Cyanide compounds are often used in connection with the plating and removal of the copper layer. Such compounds are known to be toxic. Fire clay and other known art methods of protecting portion of a ferrometallic workpiece from carburization and hardening present other individual application and removal problems. In general the coating and other protective steps are time consuming and costly.

In the carburization step of the case hardening process the ferrometallic part is heated while being exposed to carbon containing materials in a solid or gaseous state. The present state of the art principally employs a gaseous atmosphere containing a source of carbon in the carburizing and heat treating steps. During the carburizing step carbon is absorbed into and penetrates the exposed surface regions of the part. The amount of carbon absorbed and the depth of penetration of the carbon into the part are dependent upon such factors as part configuration and dimensions, temperature, time, composition of the metal (e.g. alloying agents) and the material acting as the source of carbon. Generally the penetration of carbon into the part is kept to a limit of one tenth of an inch. This depth of penetration is of course established by factors such as part thickness, degree of hardness and intended use of the part. Alloying agents in the ferrometallic part, such as chromium, nickel, manganese, silicon, phosphorus and sulfur are well known to have an effect on the amount of carbon taken up and the rate and depth of penetration of carbon into the surface during the carburizing step and the structure of the hardened metal after the heat treating step. Chromium tends to promote absorption of carbon and can lead to a fine grained structure in the hardened metal.

The heat treating of the case hardening process of the art involves heating the carburized part to a particular temperature or temperature range, holding the part at that temperature for a specified time and cooling the part rapidly or gradually. Heating the part is carried out in contact with a source of carbon, usually a gaseous atmosphere having a carbon source and a high carbon content that minimizes the loss or gain of carbon in the carburized region of the part. Rapid cooling of the part is accomplished by immersion in oil or water. Slow cooling of the part may be done by exposure to air under ambient thermal conditions.

SUMMARY

It is an object of this invention to provide a case hardening process that avoids the use of toxic materials for forming and removing protective coatings.

It is another object of this invention to reduce the number of steps in a case hardening process.

It is a further object of this invention to provide a process for hardening metals that does not require the use of a protective coating or shield in the process.

A still further object of this invention is to overcome disadvantages of prior art processes for case hardening ferrometallic parts.

These and other objects shall become apparent in the following description and accompanying claims.

DESCRIPTION OF INVENTION

Figure 1:
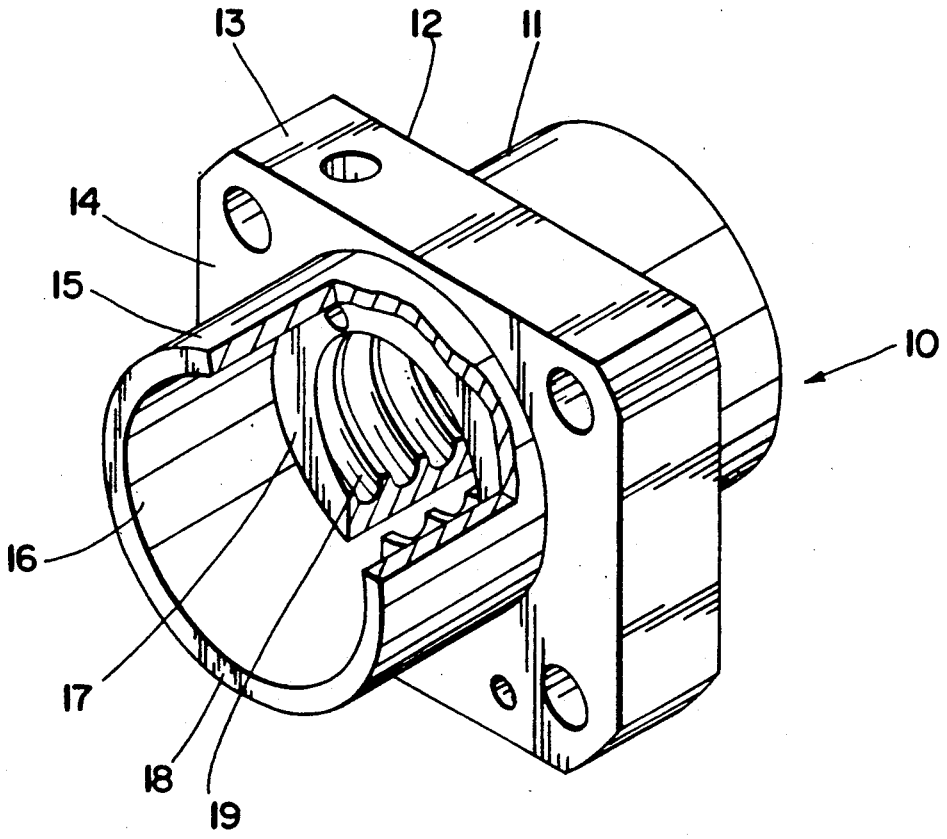
FIG. 1 is a perspective view, with sectioning, of a ball nut employed in an example of the practice of the method of this invention

The above objects and others are achieved in accordance with this invention for a method of case hardening ferrometallic parts comprising the steps of a) heating a ferrometallic part at a carburizing temperature entirely in contact with a source of carbon to produce a carburized part, b) machining the part to remove the carburized surface from a portion of the part, thereby to produce high and low carbon content surface regions, on the part, differing in carbon content by at least 100%, c) heating the machined part of step (b) at a hardening temperature with the high and low carbon content surface regions in contact with a gaseous atmosphere having 1) a source of carbon, and 2) a carbon content ranging from 85% to 115% of the carbon content present in the low carbon content surface region, and d) quenching the part.

In the practice of this invention the need for and use of a protective coating or masking, as in the case of prior art case hardening processes, is advantageously avoided. Thus the use of toxic substances, such as may be employed in the copper plating and stripping steps of prior art processes, are not needed in this invention. Fewer steps are advantageously required in the practice of this invention than are utilized in prior art case hardening methods using a protective coating or a shield and those using multiple carburizing steps.

As is well known in the art there may be used a gaseous atmosphere, containing a source of carbon, in both the carburizing and hardening steps of the prior art case hardening processes. Such prior art case hardening methods employ a gaseous atmosphere a) containing a source of carbon (e.g. carbon monoxide, carbon dioxide and gaseous or volatile hydrocarbon compounds), and b) having a high carbon content, generally a carbon content equal to or greater than the carbon to be achieved in the hardened regions of the part. Thus to achieve a hardened surface region, having for example a carbon content of 0.8% by weight, it is taught in the art that there would be employed, in both the carburizing and hardening steps of the process, a gaseous atmosphere having a carbon content of at least 0.8% and preferably a higher carbon content than 0.8% (e.g. 1.0%). However in contrast to the teachings of the prior art there is employed in the hardening step (i.e. heat treating step) or phase of this invention a gaseous atmosphere having a source of carbon and having a low carbon content. This low carbon content is essentially equal to the carbon content of the low carbon content surface region of the machined part to be hardened and is considerably below the carbon content of the high carbon content surface region of the part. More especially in accordance with the process of this invention the gaseous atmosphere employed in the hardening (i.e. heat treating) step has a carbon content ranging from 85% to 115% of the carbon content present in the low carbon content surface region of the machined part. It has been unexpectedly found that exposing a carburized part, that has been machined to form low and high carbon content surface regions differing in carbon content by at least 100%, to a hardening step wherein both the low and high carbon content surface regions are heated at a hardening temperature, while being in contact with a gaseous atmosphere having a carbon content of from 85% to 115% of the carbon content of the low carbon content surface region, can be accomplished without excessive alteration of the carbon content of the both the high and low carbon content surface regions. The low carbon content surface region of the machined carburized part may have, for example, a carbon content of from 0.05% to 0.3% by weight and the high carbon content surface region may have, for example, from 0.75 to 1.0% carbon by weight.

Temperatures employed in the step of carburizing the ferrometallic part may be those well known in the art. Such temperatures may vary with the composition of the ferrometallic part and especially wit the alloying agents and impurities therein and for example include temperatures in the range of from 1700° F. to 1800° F. In the hardening step of the art case hardening processes it is known to use temperatures in the range of from 1475° F. to 1600° F. and such temperatures in the practice of the hardening step of this invention. As in the carburizing step the temperature used in the hardening step will vary with the composition of the ferrometallic part, especially the alloying agents and impurities therein. Other factors such as the size and configuration of the part and the depth of penetration of carbon into the metal will influence the temperatures used in the carburizing and hardening steps of case hardening processes.

In the step of carburizing a ferrometallic part, in the practice of the method of this invention, it is preferred to use a gaseous atmosphere containing a source of carbon. This source of carbon can be the same or different in the carburizing and hardening steps of the method of this invention. Such sources of carbon may, for example, be carbon monoxide, carbon dioxide, natural gas, cyanogen compounds or gaseous or volatile hydrocarbons (e.g. methane, propane or butane). The quenching step of this invention may be carried out in a manner commonly practice by the art, for example by immersion in oil or water or by gradual cooling upon exposure to air at ambient temperatures.

The term ferrometallic, as employed in this description and in the accompanying claims, is meant to define metals having an iron content of at least 50% by weight. Such metal commonly contain alloying agents that include chromium, nickel, manganese and vanadium in small amounts. Impurities such as silicon, sulfur and phosphorus may be present in the metal. Carbon, in amounts less than 0.5% by weight may also be present in the ferrometallic part prior to the carburizing step.

It is well known in the art to avoid excessive changes in the carbon content of the carburized (i.e high carbon content) surface regions of the part during the hardening step of the case hardening process. Such changes are controlled or avoided by the prior art by use of a high carbon content gaseous atmosphere (typically a gaseous atmosphere having a carbon content substantially the same as the carbon content of the hardened surface region) and by controlling or limiting the exposure time of the part to the high temperature in the hardening step. This control or limiting of the exposure at the high temperature is primarily determined by the part size and shape, by the depth of penetration of carbon into the hardened surface region and by the need to prevent the deterioration or destruction of the protective coating covering the non-hardened (i.e soft or low carbon content) regions of the part. In the practice of this invention it has been found to be advantageous to prevent excessive changes in the carbon content of the hardened regions of the part during the hardening step by controlling or limiting the exposure time of the part at the hardening temperature. Such control or limiting of the exposure time is based primarily on the composition, size and shape of the part and the amount and depth of penetration of the carbon into the hardened surface regions. Since in accordance with this invention the part is heated in a gaseous atmosphere having a carbon content substantially the same as the carbon content of the non-hardened (i.e. low carbon content) surface region of the part during the hardening step, thereby obviating the need for the prior art protective coating over such region, excessive changes in the carbon content of the low carbon content surface region of the part are avoided during the hardening step.

In a practice of this invention an 8620 steel machined ball nut 10, shown in the three dimensional view of FIG. 1, was carburized by heating the nut 10 in a furnace at 1750° F. for 10 hours under a carbon containing atmosphere having a carbon content of 0.90% by weight. This carbon containing atmosphere was provided by a mixture of carbon dioxide, carbon monoxide and water vapor. Carburization of the ball nut 10 was carried out to a depth of 0.032 inches. The ball nut 10 was then removed from the furnace and permitted to cool to room temperature under ambient air temperature conditions. Upon cooling to room temperature surfaces 11, 12, 13, 14, 15, 16, and 17 of ball nut 10 were machined to remove the carburized surfaces and reveal the essentially original metal composition thereunder (i.e. the metal having a carbon content essentially the same as that before the above carburization step). The ball track 19 and surface 18 were not machined and therefore remained carburized (i.e. having a carbon content higher than the metal before carburization). Ball nut 10 was the given a hardening treatment by heating it in a furnace at 1550° F. for 2 hours under a carbon containing atmosphere having a carbon content of 0.20% by weight. This carbon containing atmosphere was provided by a mixture of carbon dioxide, carbon monoxide, water vapor and nitrogen. The heated ball nut 10 was then quenched in oil to achieve a Rockwell Hardness C of 60 on surface 18 and ball track 19.

What is claimed is:

1. In the case hardening of a ferrometallic part a process comprising the steps of a) carburizing the entire part, b) machining the part from step (a) to thereby form first and second surface regions, said second region having a carbon content at least 100% greater than the carbon content of said first region, c) heating the machined part from step (b) to a hardening temperature while the entire surface of the part is in contact with a gaseous atmosphere containing a source of carbon and having a carbon content of from 85% to 115% of the carbon content of the first region and d) quenching the part.

2. A process according to claim 1 wherein said hardening temperature is in the range of from 1475° to 1600° F.

3. A process according to claim 1 wherein the second region is machined after step d).

4. The process according to claim 1 wherein the source of carbon is selected from the group consisting of carbon dioxide and carbon monoxide.

5. The process according to claim 1 wherein the source of carbon is a volatile or gaseous organic compound.

* * * * *